US008568179B2

(12) United States Patent
Huguet Casali

(10) Patent No.: US 8,568,179 B2
(45) Date of Patent: Oct. 29, 2013

(54) MULTIDIRECTIONAL PROPULSION SYSTEM FOR SHIPS, INCLUDING A MECHANICAL HYPOCYCLOID TRANSFORMER

(76) Inventor: Miguel Huguet Casali, Islas Baleares (ES)

( * ) Notice: Subject to any disclaimer, the term of this patent is extended or adjusted under 35 U.S.C. 154(b) by 88 days.

(21) Appl. No.: 13/266,743

(22) PCT Filed: Dec. 29, 2010

(86) PCT No.: PCT/ES2010/000530

§ 371 (c)(1),
(2), (4) Date: Oct. 27, 2011

(87) PCT Pub. No.: WO2011/064420

PCT Pub. Date: Jun. 3, 2011

(65) Prior Publication Data

US 2012/0045950 A1 Feb. 23, 2012

(30) Foreign Application Priority Data

Dec. 30, 2009 (ES) ..... 200902421

(51) Int. Cl.
*B63H 1/36* (2006.01)

(52) U.S. Cl.
USPC ..... 440/14

(58) Field of Classification Search
USPC ..... 440/13–15, 93
See application file for complete search history.

(56) References Cited

U.S. PATENT DOCUMENTS

| | | | | |
|---|---|---|---|---|
| 1,774,206 | A * | 8/1930 | Meindersma | 440/13 |
| 2,180,890 | A * | 11/1939 | Weatherwax | 416/83 |
| 2010/0151751 | A1 * | 6/2010 | Jemt | 440/14 |

* cited by examiner

*Primary Examiner* — Edwin Swinehart
(74) *Attorney, Agent, or Firm* — Hamre, Schumann, Mueller & Larson, P.C.

(57) ABSTRACT

The invention relates to a multidirectional propulsion system for ships, including a mechanical hypocycloid transformer, which comprises a drive system (100) of the mechanical hypocycloid transformer type and which performs two basic functions, namely: generating the oscillating rotational movements of the two concentric shafts (15, 16) in order to move the propeller blades, and rotating integrally about the geometric axis thereof, such that the range of the sweep angle of the swing frames (17, 17') can be varied gradually between an upper threshold and a lower threshold both when the propulsion system is in operation and stopped. The invention also includes a multidirectional connection system which can change the orientation of the propulsion force of the blades and, consequently, the direction of movement of the ship and which comprises a clutch on each concentric shaft each clutch having two discs. The invention further includes a submerged part, formed by a fish-tail propulsion.

6 Claims, 9 Drawing Sheets

MULTIDIRECTIONAL PROPULSION SYSTEM FOR SHIPS, INCLUDING A MECHANICAL HYPOCYCLOID TRANSFORMER

TECHNICAL FIELD OF THE INVENTION

This invention is encompassed within the field of shipbuilding, more particularly, within the propulsion and steering systems for boats, especially motor ships.

BACKGROUND OF THE INVENTION

The clear advantages that the multidirectional propulsion system has over the current means for propulsion and maneuvering ships are known and described in document ES 2319149 A1 of the same applicant. Specifically, the invention described in document ES 2319149 A1 is characterized by pursuing two main objectives such as: increasing the propulsion efficiency and improving the maneuverability of ships.

In general, in order to increase the propulsion efficiency, said document provides a mechanism formed by a connecting rod crank-type drive system that moves a main oscillating axis; integral with said axis are the swing frame (structure that supports the blades) and the blades. When the axis (which is perpendicular to the surface of still water) rotates, drags the blades that are responsible for exerting the propulsion force that moves the ship.

As for improving the maneuverability of the ship a multidirectional connecting mechanism is described, which consists of a sling and other driving disc and an additional mechanism which is responsible for separating both discs, rotating the axis in the desired direction and reassembling the two discs. In this way the blades can be oriented in the desired direction, from 0° to 360°.

This invention substantially improves in the previous development, both in the way of generating the propulsion force and in the direction thereof with respect to the ship, by introducing a number of essential elements described below.

There are other documents as U.S. Pat. No. 272,949 (Augustus M. Freeman, 1883), which shows an oscillating propulsion system based on double set of pivoting fins mounted on "swing frames" that rotate alternately, in an oscillatory or reciprocating motion, about the same vertical axis to produce the effort force. However, this boat is a type of hand-propelled boat, which for construction issues, does not have the possibility of adapting to any mechanical propulsion or multidirectional connection mechanism.

As for the propulsion system, without the structure and swing frames and blades of the invention, the document U.S. Pat. No. 6,193,466 describes a propeller system based on blades that rotate in opposite directions jointly connected to two coaxial vertical shafts moved by transmission gears. In this case the movement performed by the axes is not alternating like that of the presented invention, with a minimum and a maximum sweep angle, but it is circular (360°), so that the speed cannot be adjusted by regulating the range of the sweep angle of the blades. Additionally, in this document the push orientation mechanism or govern mechanism is driven by a rudder tiller.

As for the multidirectional connection mechanism, document U.S. Pat. No. 2,573,382 shows a gear reverse mechanism, i.e. it changes its orientation but only in two positions 0° or 180°. This mechanism has the disadvantage of not allowing maneuvering, for example, at a dock.

Document WO2005/047100 shows a way of varying the direction of the boat but using a system different from that of the invention and which could not be adapted to the propulsion type of our ship, since in this case what is varied is the attack angle of each blade, which are mounted on an endless chain.

Document U.S. Pat. No. 975,972 proposes a set of three propellers (one central and two laterals) using two concentric shafts but with full rotations (not oscillating) and proposes a drive system different from that of the invention claimed here (it is not hypocycloid) with a multidirection not applicable to a single propulsion line.

Document U.S. Pat. No. 4,568,290 proposes the use of two oscillating, non-concentric shafts for the propulsion. The multidirection is not so by not being able to take turns of 360° on the horizontal plane.

Thus, none of the documents found by the applicant discloses a system for motor ships that has a propulsion and, at the same time, a rotation equipment, which solve together the problems found in the developments so far known and having a proven efficiency much higher than that of systems currently existing.

DESCRIPTION OF THE INVENTION

The present invention is provided, for each propulsion line, with a part submerged into the water, similar to others existing in the state of the art, and which consists of two concentric shafts rotating and oscillating in an opposite direction to one another (opposing paths). These shafts transmit an oscillating motion, of the fish-tail type, with a sweep angle between two thresholds (upper threshold and lower threshold) to two swing frames, each formed by a swing frame body joined to arms, on which the blades, which will be those responsible for generating the propulsion force to move the ship, are mounted. This transmission of the oscillations from the shafts to their corresponding swing frames is performed through an elastic means sandwiched between each shaft and its corresponding swing frame body, in order to provide elasticity to the propulsion line and thus preventing vibrations.

To generate the propulsion force needed to move the ship, there is provided the propulsion motor for the ship which, via a drive system of the mechanical transformer of the hypocycloid type, transmits its movement to the concentric shafts.

To understand the operation of the drive system it should be remembered that a hypocycloid is the curve that describes the trajectory of a point located on a generatrix circumference that rolls, without sliding, within another directrix circumference and which, when the diameter of the rolling circumference is half the diameter of the directrix circumference, the generated hypocycloid is a straight line with the same length as the diameter of the directrix circumference.

Thus, the mechanical hypocycloid transformer of the invention has been designed so that those straight lines that are generated correspond to the paths traveled by the bolts of two connecting rods, which attached to two drive discs, move the two concentric shafts and these, in turn, the propeller blades.

The use of two concentric rotating and oscillating (roto-oscillating) shafts and with paths in opposite directions instead of a single roto-oscillating shaft is justified by the need of cancelling the lateral components generated by the blades in operation, which would be impossible to achieve with a single shaft.

The outer shaft is always tubular and the interior is tubular or solid. Its working position is perpendicular to the surface of still water, certain inclination towards the stern being admissible on the symmetry longitudinal plane of the ship or on two planes parallel thereto, if the ship carries two propulsion lines, taking as vertex of the angle of this inclination, the lower end of the corresponding inner shaft.

The use of the mechanical hypocycloid transformer as drive system allows gradually varying the value of the sweep angle of the swing frames between its two thresholds (upper threshold for the largest possible sweep angle and lower threshold for the smallest possible sweep angle). This gradual variation between both thresholds can be performed both with the propulsion line operating, active, and when it is inactive.

It should be emphasized that when the propulsion line is in action, the variations applied to the sweep angle of the swing frames, result in different responses for the propulsion generated, which can go gradually from sweeps of less range (lower threshold) to sweeps of large range (upper threshold).

This variation in the range of the sweep angle of the swing frame is possible because the hypocycloid transformer (drive system) is allowed to entirely spin as a whole around its own geometric axis, which allows changing the orientation of the reciprocating (hypocycloid) rectilinear path described by the bolts of the connecting rods, with this action being the one that changes the mentioned sweep angle of the swing frames.

The details of the drive system are more specifically explained in the preferred embodiment of the invention.

The propulsion system includes a multidirectional connection system that allows reorienting the propulsion force generated by the blades in any horizontally direction and orientation between 0° and 360°, so that the boat can travel, for example, laterally to dock at a pier.

This system comprises two clutches, one on each of the concentric propeller shafts, which allow disconnecting and connecting said shafts to the drive system, which is necessary to make the change of orientation of the blades (the basic principle of multidirectionability) as it is required that the drive system be disconnected. Each clutch consists of two discs, a driving one and a sliding.

Each driving disc is connected to the drive system through a connecting rod and is responsible for transmitting the oscillating motion to the swing frames through its corresponding axis. The sliding disc can only slide along its corresponding axis to be separated from the former one.

The joining together of the two discs of each clutch to perform their function of transmitting the reciprocating movements of the concentric rods to the corresponding concentric shafts, can be a simple mechanical, electromechanical connection, or any equivalent system.

For the simultaneous connection-disconnection of the sliding discs from the two axes, an auxiliary mechanism that can be, depending on the type of ship, electromechanic, hydraulic, etc. can be used.

For the rotation of the concentric shafts during reorientation changes of the blades to be performed in sync manner once disconnected, a device for synchronizing both axes is used.

The actions of the auxiliary mechanism and those of the synchronization device are antagonistic: when one is disconnected the other comes into action automatically and vice versa. That is, if the auxiliary mechanism disconnects the drive system from the concentric shafts, then the synchronization mechanism connects the two axes so that their rotation is integrally performed.

In addition, a rotation mechanism is connected to the upper end of the inner shaft to be able to rotate the two axes about themselves, once disconnected and synchronized, until reaching a new orientation for the propeller blades.

These disconnected and synchronized axes are rotated by the action of the rotation mechanism until they reach the new direction chosen for the thrust of the blades, at which time the auxiliary mechanism by reversing its action will reconnect the sliding discs to the corresponding drive, while simultaneously and automatically cancels the temporary connection of the two axes, created by the synchronization device. The rotation mechanism can take various forms, none of them mandatory, depending on the type and size of the ship.

There are many advantages obtained with this new propulsion and rotation system for ships such as, among others:

1. Real multidirectionability of 360° during operation of the ship: actions for directing, displacing, maneuvering the ship (rhumb, gear forward, reverse, docking, etc.) available in any horizontal direction and orientation.
2. Compensation for the lateral forces generated by the blades during their propulsion work avoiding vibrations, thanks to the double shaft with opposite and synchronized rotations (opposing paths).
3. Possibility to vary the range of the sweep angle of the blades during the operation of the ship, for increasing or decreasing the sweep speed of the blades, and all this while maintaining the number of revolutions of the drive system fixed.
4. Eliminating the use of the traditional horns and their corresponding gaskets, typical of the horizontal axes when conventional propellers are used, since the passage of the concentric shafts through the hull is performed above the sea level.

All this results in an a very important improvement in the performance and efficiency over everything existing in the state of the art, which means lower costs and much better results.

DESCRIPTION OF THE DRAWINGS

To complete the description being made and in order to help better understand the features of the invention a set of drawings is attached, wherein in an illustrative and not limitative manner the following has been represented.

Figure 1:
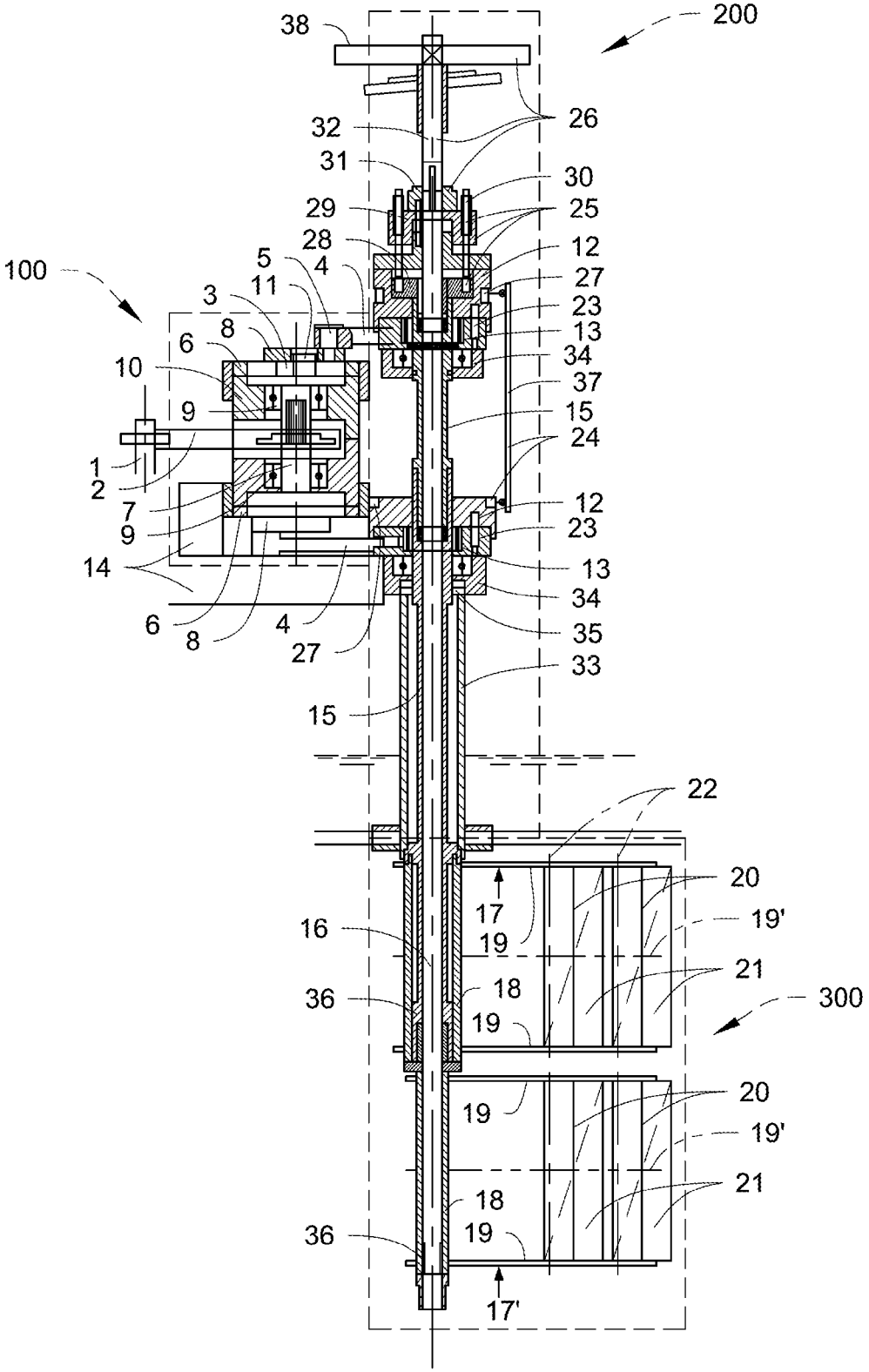
FIG. 1: General scheme of the invention

As the references are numerous, for clarity the following is a list of all them:

1. Drive shaft. Receives the rotations from the propulsion motor of the ship
2. Drive chain drive. Gears, chains-sprocket wheels, etc.
3. Satellite gears (rolling circumferences)
4. Connecting rods
5. Rotating bolts of the connecting rods
6. Directrix crown wheel (directrix circumference)
7. Main shaft
8. Bolt discs (integral with the respective satellite gears)
9. Main shaft bearings
10. Mechanical hypocycloid transformer body (two halves coupled)
11. Satellite gear bearings

12. Sliding disc
13. Driving disc
14. Support for the mechanical connection between the mechanical hypocycloid transformer and the remaining multidirectional propulsion system
15. Outer axis
16. Inner axis
17. Upper swing frame
17'. Lower swing frame
18. Bodies of the swing frames
19. Arms of the swing frames
19'. Intermediate arms (optional)
20. Tops of the blades
21. Blades
22. Axes of the blades
23. Male-female inserts
24. Auxiliary mechanism to separate the two sliding discs
25. Synchronization device for the concentric shafts
26. Rotation mechanism for rotating the two shafts together, during the reorientation of the propulsion force
27. Auxiliary mechanism bearings
28. Synchronizer disc
29. Support disc of the synchronizer
30. Synchronizer Punches
31. Ring of the rotation mechanism
32. Rotation mechanism axis
33. Hull protector for the two concentric shafts
34. Bearings-support for the outer axis
35. Hull protector detents
36. Elastic connection of the swing frames
37. Partition bars of the sliding discs (12)
38. Flywheel of the rotation mechanism
100. Drive system
200. Multidirectional connection system (guidance system for the ship propulsion)
300. Part of the propulsion line that is submerged

PREFERRED EMBODIMENT OF THE INVENTION

To achieve a better understanding of the invention, all elements comprised by the multidirectional propulsion system with the mechanical hypocycloid transformer for ships will be described in detail, as well as the operation thereof.

FIG. 1 shows a general scheme for a propulsion line, of the entire assembly of the invention. The drive system, of the mechanical hypocycloid transformer type (100), the multidirectional connection system or system for orientating the propulsion force of the ship (200) and the part of the propulsion line that is submerged in water (300).

The part of the propulsion line that is submerged in water, although with certain variants, is similar to those existing in the state of the art. It comprises two roto-oscillating concentric shafts (15, 16), two swing frames (17, 17') each formed by a body (18) being joined to the main arms of the swing frames (19), with the option of introducing between these main arms (19) some intermediate arms (19'), the axes of the blades (22), two or more stops on each blade (20) and the blades (21). The two concentric and roto-oscillating shafts (15, 16) will transmit an oscillating motion to their corresponding swing frames (17, 17'), creating a fish tail movement, and will make it through an elastic mean (36) sandwiched between the body of each swing frame (18) and the fixation to its corresponding axis, all of this in order to provide elasticity to the propulsion line and thus avoiding vibrations.

One of the differences that the claimed invention has over other patents of the state of the art is that in the present case the two concentric shafts (15, 16) never make complete revolutions about their common geometric axis. These rotate about said geometric axis in opposite directions (opposing paths) a fraction of a turn (sweep angle) and return to their original position to complete the oscillation. The magnitude of this sweep angle (β, FIG. 3) can be varied gradually between two thresholds (upper threshold, FIG. 3A and lower threshold, FIG. 3B, wherein the sweep angle (β) is 0°), even when the propulsion line is working, and all this without the need to vary the number of revolutions of the drive system (100).

These variations in the sweep angle (β) of the shafts (15, 16) are, of course, received through the swing frames (17, 17'), their corresponding blades (21) and this has an effect on the type of response to the forward movement of the ship.

Figure 3A:
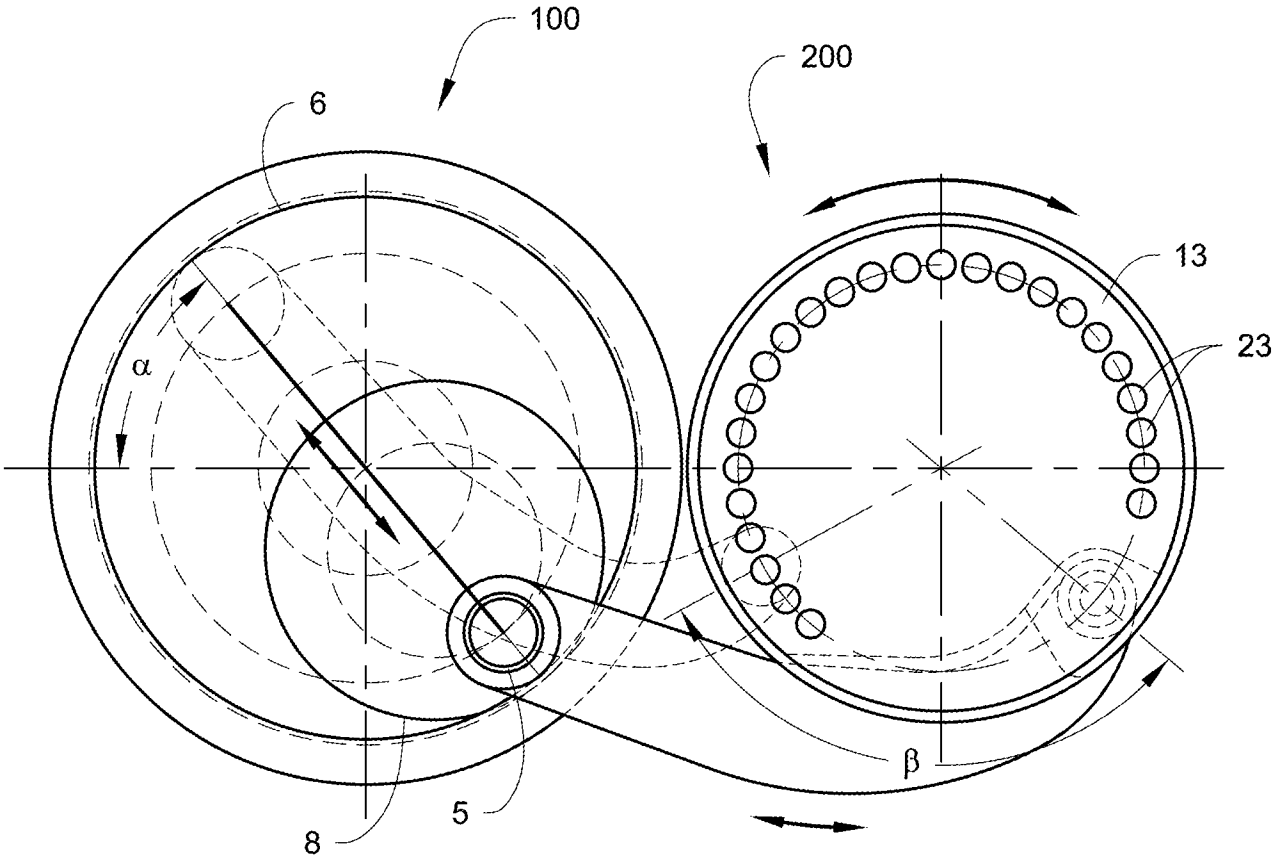
FIG. 3: Schematic plan view of the variation of the sweep angle (beta) of the blades, between the upper (A) and lower (B) thresholds
Figure 3B:
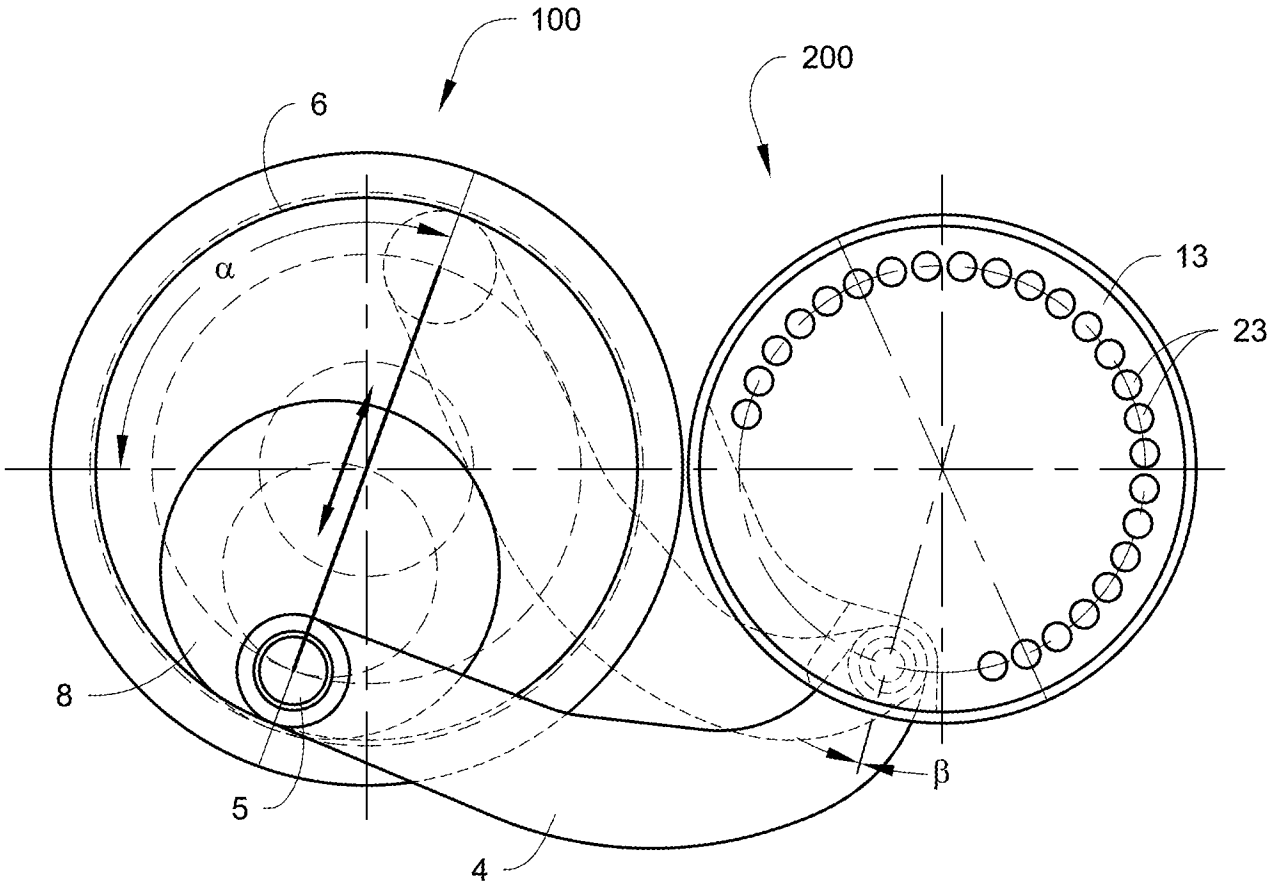

The fact that the mechanical hypocycloid transformer (drive system 100) can be all of it rotated about its geometric axis, allows varying the orientation of the hypocycloid travel of bolts (5) (FIG. 3, straight line H), thus varying the magnitude of the hypocycloid angle (α), which is directly related to the value of the sweep angle (β), from 0° of the lower threshold (FIG. 3B) to the upper threshold (FIG. 3A).

Figure 2:
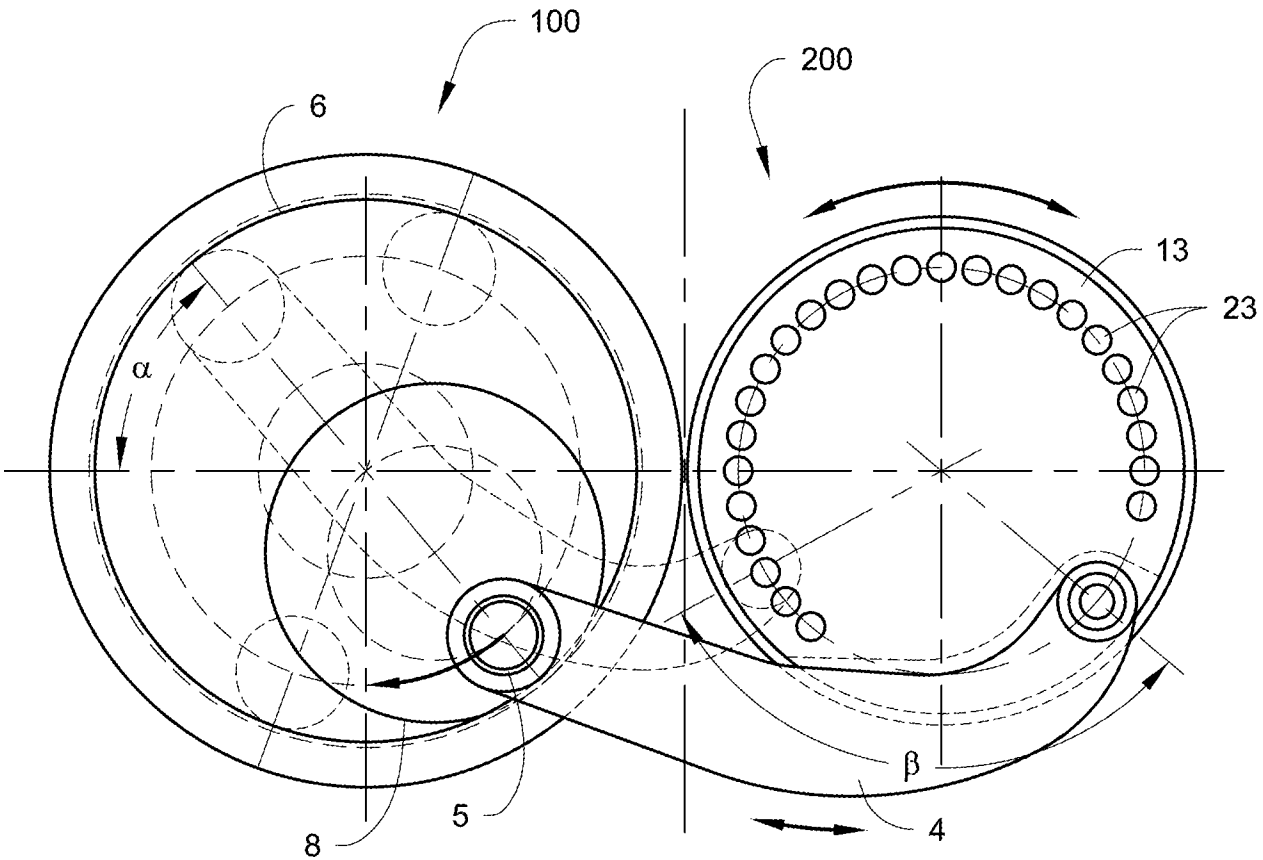
FIG. 2: Schematic plan view of the mechanical hypocycloid transformer and its relation to the driving discs
Figure 4:
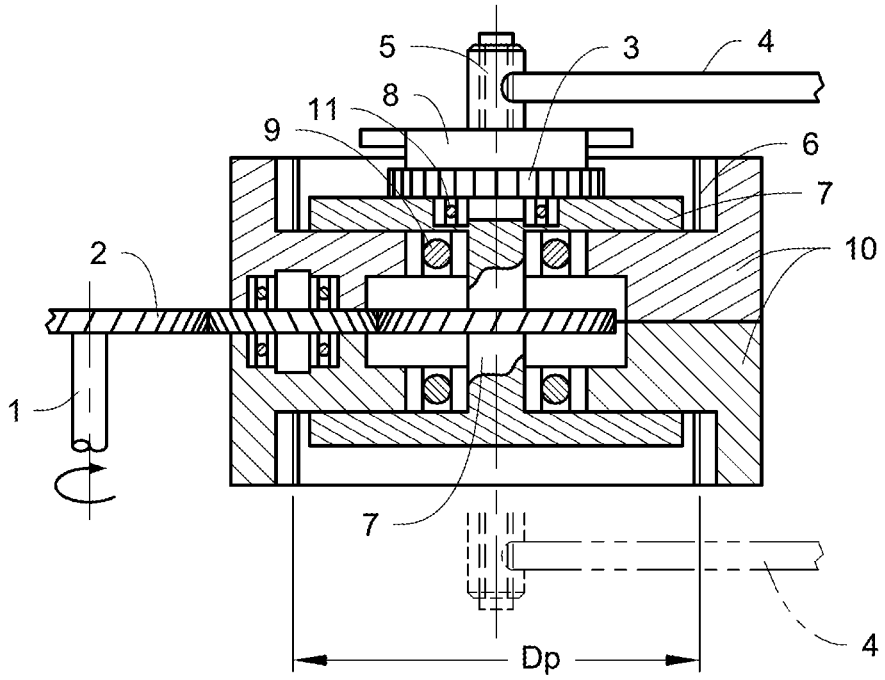
FIG. 4: Detail of the section AB of FIG. 2
Figure 5:
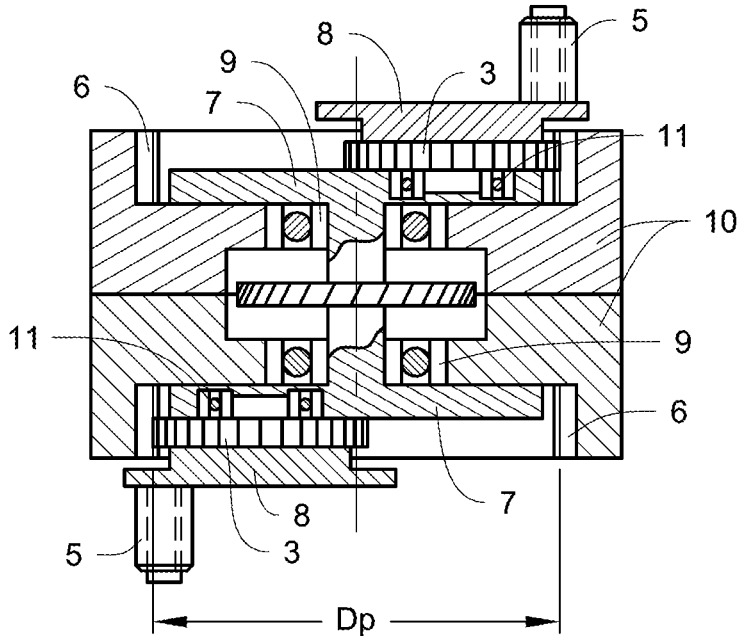
FIG. 5: Detail of the section CD of FIG. 2

FIG. 2 (for better clarity represents only one of the two driving discs, the upper one, and its corresponding connecting rod) shows a schematic plan view of the mechanical hypocycloid transformer (100) and its relation to the driving discs (13) through their connecting rods (4) and two sections detailed in FIGS. 4 and 5 are marked, and which will allow us to describe the mechanical hypocycloid transformer.

As shown in FIGS. 4 and 5, the body of the mechanical hypocycloid transformer (100) consists of two coupled halves (10).

The drive system of the mechanical hypocycloid transformer type (100) is a mechanism designed to transform the rotations from a drive shaft (1) through a drive chain (2), into two straight hypocycloid movements with well defined lengths and paths, and in particular for its application to obtain the two roto-oscillating movements of the two concentric shafts (15, 16) of the propulsion line.

The drive system of the mechanical hypocycloid transformer type (100), as shown in FIGS. 1, 4 and 5, comprises a drive shaft (1) that receives the rotations of the ship propeller motor and which is joined to a drive chain (2) of optional type (belt, gears, chain . . . ) are transmitted via the main shaft (7) to two satellite gears (3), so that these roll within their respective crown wheels (6) and thus generate the mentioned rectilinear movements applicable to both shafts (15, 16).

These satellite gears (3) integrally rotate about the bolt discs (8).

Figure 6:
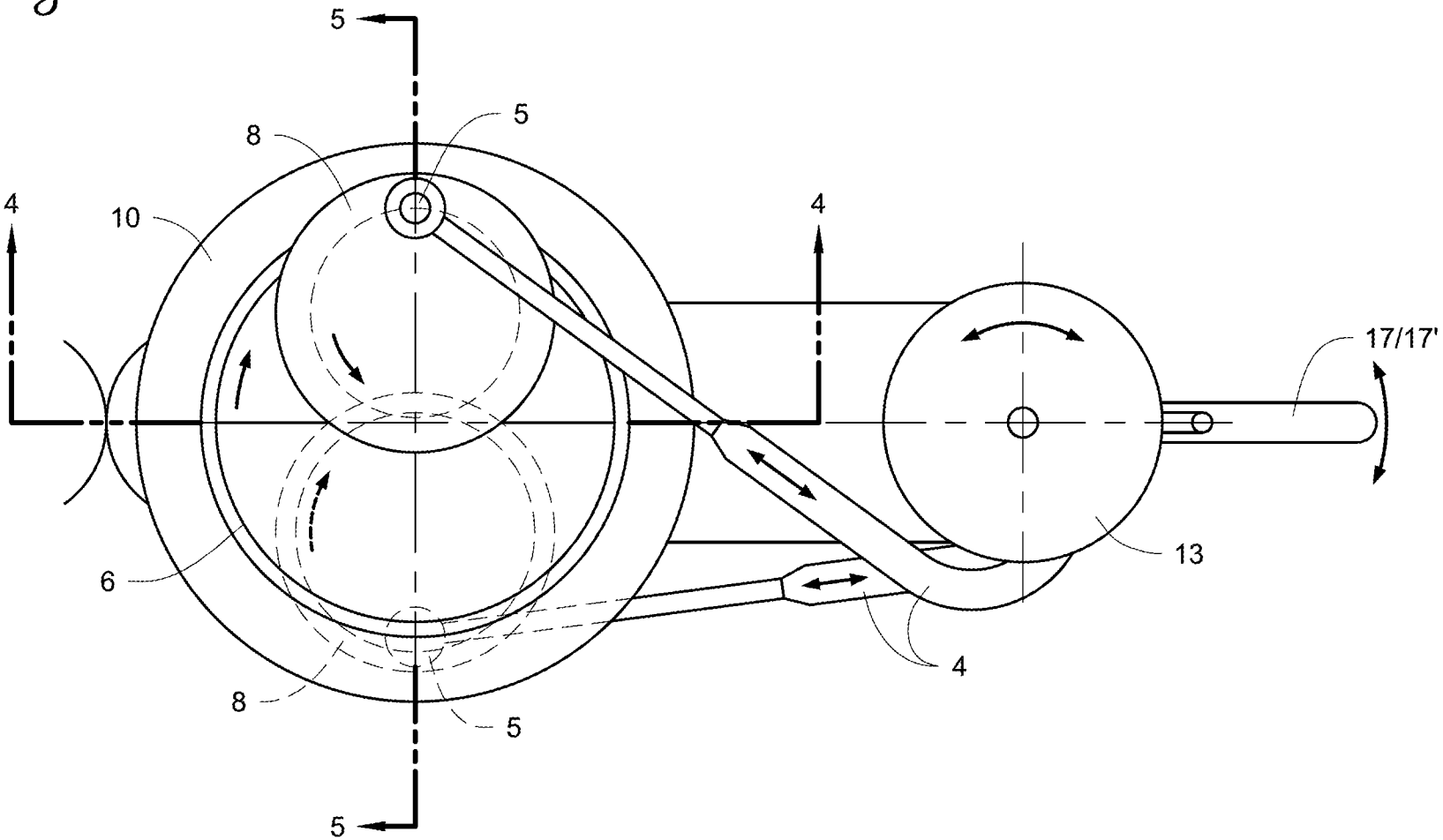
FIG. 6: Schematic plan view of the complete propulsion line

The bolt discs (8) have each installed a bolt (5). With the bolts (5) mounted at 180° from each other (FIG. 6) and with the connecting rods (4) working on the same side of the propulsion line, the magnitude of the rotations (oscillations) of the concentric shafts (15, 16) is achieved to be exactly equal and in opposite directions (opposing paths).

The discs (8) serve for mechanically coupling the bolts (5) to their corresponding satellite gears (3).

The bolts (5), by describing their rectilinear (hypocycloid) movement move the connecting rods (4) that transmit their reciprocating movement to the driving discs (13) and these to their corresponding concentric shafts (15, 16).

The connecting rods (4) are constructed so as to be elastic, enough as to absorb, during the operation of the propulsion line, the sudden efforts generated when passing through their dead spots.

Returning to FIG. 2, it shows that the path length of each of the bolts (5) and consequently of the connecting rods (4), is equal to the length of the pitch diameter of the directrix crown wheel (6). This is because, as noted above, in a hypocycloid, when the diameter of the rolling circumference (pitch diameter of the satellite gear (3)) is half the diameter of the directrix circumference (pitch diameter of the crown wheel (6)), the hypocycloid generated is a straight line with the same length as the pitch diameter of the directrix circumference (6).

Thus, the connecting rods (4) generate a reciprocating rotating motion on each driving disc (13). Each of the two concentric shafts (15, 16) has associated one of the two driving discs (13) which transmit the movement received from the connecting rods (4), so that both shafts (15, 16) rotate and oscillate synchronized and in opposite directions (opposing paths), such as it was sought so that the side efforts of the blades (21) when working cancel each other.

Both the main shaft (7) and satellite gears (3) have respective bearings (9, 11) that allow their proper operation.

After the explanation on the drive system (100) of the hypocycloid type it should be noted that the most important purpose of this mechanism, is the fact that it transforms the rotating movement of the main shaft (7) into two rectilinear movements through hypocycloid paths and its transmission via the two connecting rods (4) to their respective shafts (15, 16), so that these roto-oscillate completely synchronized but in opposite directions (opposing paths).

The additional technical effect achieved by the fact of using a hypocycloid in lieu of any other method is being able to change, with the ship in operation, the range of the sweep angle (β) of the propeller blades (FIGS. 3A and B).

The mechanical connection between the mechanical hypocycloid transformer (100) and the multidimensional connection system (200) is performed through a special support (14), which allows two basic things:

1. Maintaining a solid mechanical connection between the mechanical hypocycloid transformer (100) and the rest of the propulsion line.
2. Allowing the rotation of the entire mechanical hypocycloid transformer (100) about its own geometric axis.

With this rotation of the transformer the magnitude of the sweep angle (β) of the swing frames (17, 17') can be varied (as explained above), by varying the orientation of the rectilinear path of bolts (5) (varying the hypocycloid angle, α). This change of the sweep angle (β) is feasible both if the propulsion line is working, and if it is stopped.

As for the multidirectional connection system (200) to change the orientation of the propulsion of the ships shown in FIG. 7, it includes:

Two clutches, one on each shaft (15, 16), that allow disconnecting both shafts (15, 16) from the drive system (100). Each clutch consists of two discs, the driving one (13) and the sliding one (12). Both driving discs (13) can freely rotate on the outer shaft (15) and are connected to the drive system (100) through their corresponding connecting rods (4). The sliding discs (12) can only slide on their corresponding axis, to be separated (disengaged) from their driving discs (13). In a preferred embodiment, the two discs (12, 13) have, on their contact faces, male-female inserts (23), which allow the transmission, when the discs (12, 13) are together, of the reciprocating movements of the connecting rods (4) to their corresponding shafts (15 and 16), to make them oscillate.

An auxiliary mechanism (24) for simultaneously moving, the sliding discs (12) of the two clutches. This auxiliary mechanism (24) simultaneously moves the two sliding discs (12) to separate them (disconnect) from or join them (connect) to their driving discs (13). The mechanism can be triggered, depending on the type of ship, in various forms (mechanical, electromechanical, hydraulic, etc.). Among the various types of construction that can take the auxiliary mechanism, in the preferred embodiment two rods (37) are used (FIGS. 1, 7, only one is represented for clarity), which are parallel and diametrically opposed (one on each side of the multidirection) and which can be simultaneously raised or lowered to move the two sliding discs (12), through the four bearings (27) housed in pairs into the respective annular slots made in the body of both sliding discs (12) and loosely enough as hot to hamper the roto-oscillations of these discs (12) during the operation of the propulsion line.

A synchronization mechanism (25) of the two shafts (15, 16) in order to rotate them together (synchronized) when these are already disconnected from the drive system (100), during changes in direction of the propulsion force. During the simultaneous separation of the two sliding discs (12) the displacements of the upper sliding disc (12) (the inner shaft, (16)), causes the automatically actuation of the synchronization device (25) of the two shafts (15, 16), thus creating a temporary connection between both shafts (15, 16) already disconnected, which allows rotating them together about themselves without changing their radial relation (synchronized).

The synchronization device (25) is designed to perform its function regardless of the random relative angular position on which the shafts (15, 16) will be stopped by performing its last oscillation, after stopping the rotations of the drive shaft (1).

Among the various types of construction that can take the synchronization device, the preferred embodiment uses:

- A synchronizer disc (28) that can slide, but not rotate, on the upper end of the outer shaft (15) and which is housed in the body of the upper sliding disc (12) and on its upper face carries a crown with holes.
- A support disc (29), fixed on the inner shaft (16), with eight punches (30), weighted with springs and angularly offset from each other, so that at least one of them fits into one of the holes in the disc (28) when raised along with the upper sliding disc (12), during the disconnection operation of the shafts (15, 16) for forming the temporary connection between both (synchronization).

A rotation mechanism (26), which is simultaneously connected when the synchronization device (25) does it, to the upper end of said inner shaft (16), in order to be able to rotate the two axes (15, 16) together, once disconnected and synchronized, to the new orientation of the swing frames (17, 17'). These synchronized shafts (15, 16) can be rotated by actuating the rotation mechanism (26) until the swing frames (17, 17') reach the new direction chosen for the thrust of the blades (21), at which time the auxiliary mechanism (24) reversing its action will connect again the two sliding discs (12) to the corresponding drives (13), while simultaneously and automatically the temporary connection of the two shafts (15, 16), previously created by the synchronization device (25) is released. The rotation mechanism (26) can take several forms, none of them mandatory and will depend on the type and size of the ship. Its actuation will usually be manual.

Among the various types of construction that can take the rotation mechanism, in the current preferred embodiment was chosen the use of:

- A rotation axis (32) with the lower head grooved, fixed in height and which can be rotated about its geometric axis by a flywheel (38, FIG. 1) attached to the upper end of said axis (32).
- An inner spline ring (31) that when is raised accompanying the upper sliding disc (12) is inserted into the spline of the axis (32) thus creating a temporary connection between the two shafts (16, 32), which allows transmitting the rotations of the flywheel (38) to the two concentric shafts (15, 16) recently synchronized.

Then, and based on FIGS. 7 and 8, it will be explained what happens after stopping the rotations of the drive shaft (1) as a previous stage for making any changes in the orientation of the swing frames (17, 17') in order to vary the direction and sense of the propulsion force (multidirection).

Figure 7A:
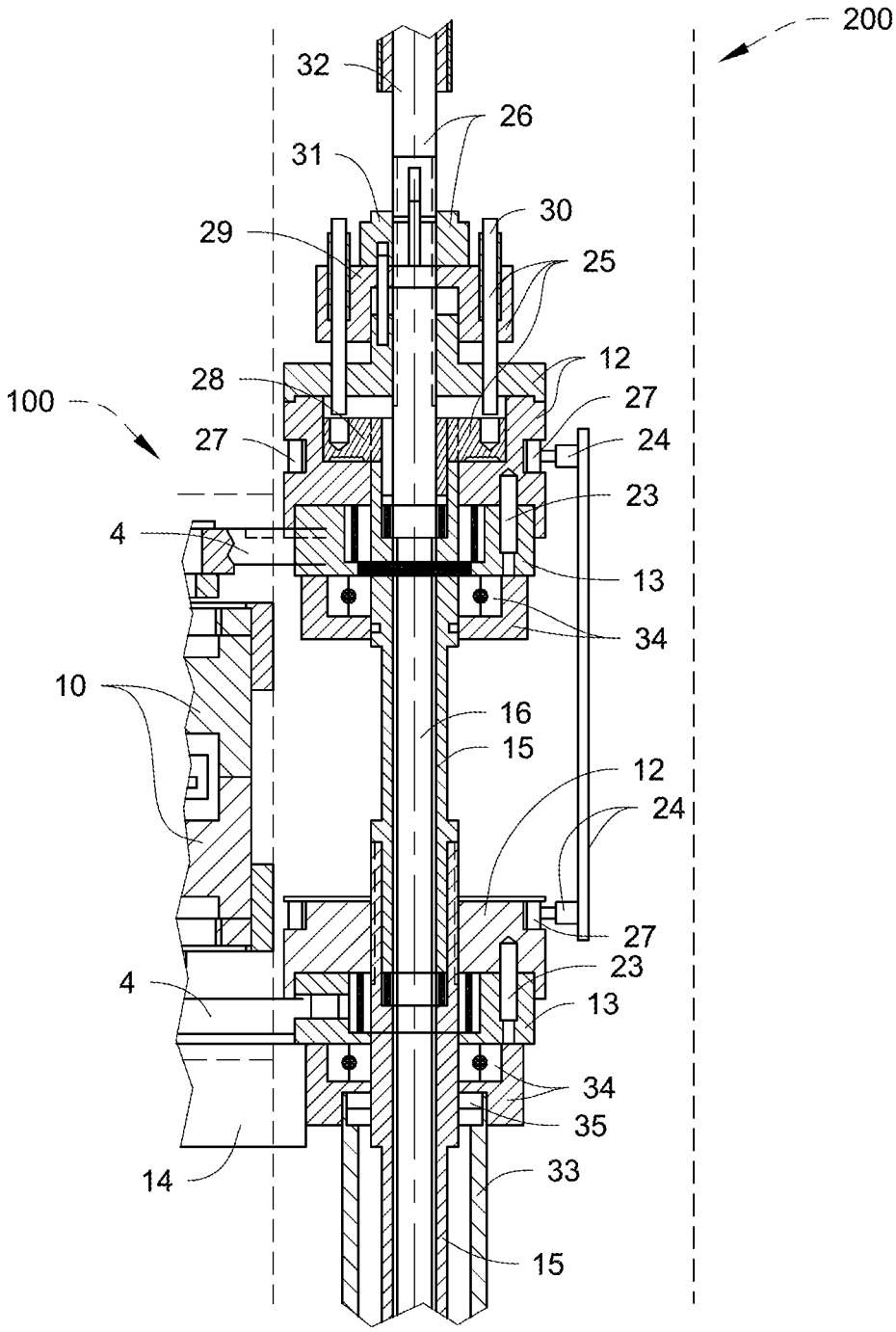
FIG. 7: Details of the multidirectional connection, connected (A) and disconnected (B).

FIG. 7A shows the propulsion line connected. With the clutches closed, the movement is transmitted from the drive system (100) to the blades (21), creating the propulsion.

Figure 7B:
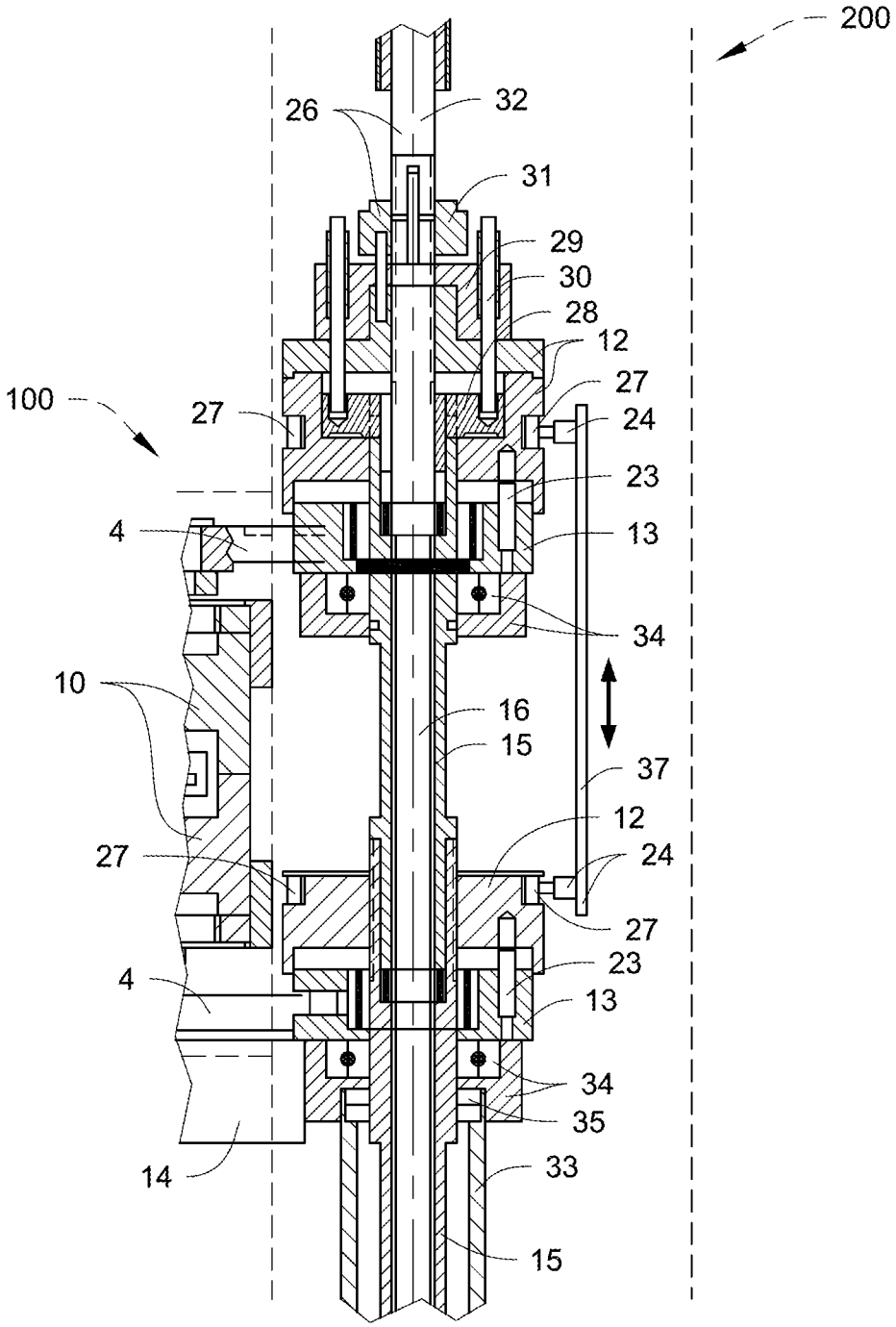

FIG. 7B shows the propulsion line disconnected. This disconnection is the previous and necessary stage for rotating the two synchronized shafts (15, 16) to a new direction of the blades (21).

Figure 8B:
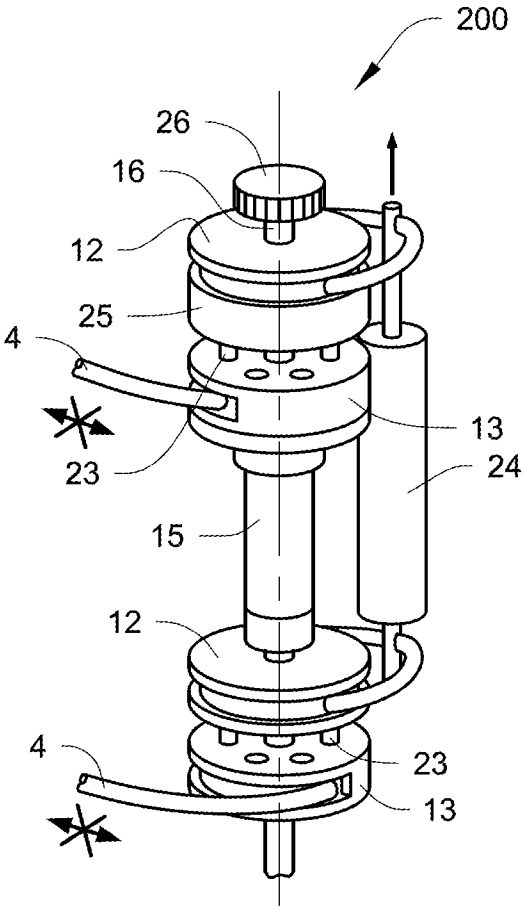
FIG. 8: Schematic perspective view of the multidirectional connection, disconnected (A, synchronized axes) and connected (B).
Figure 8A:
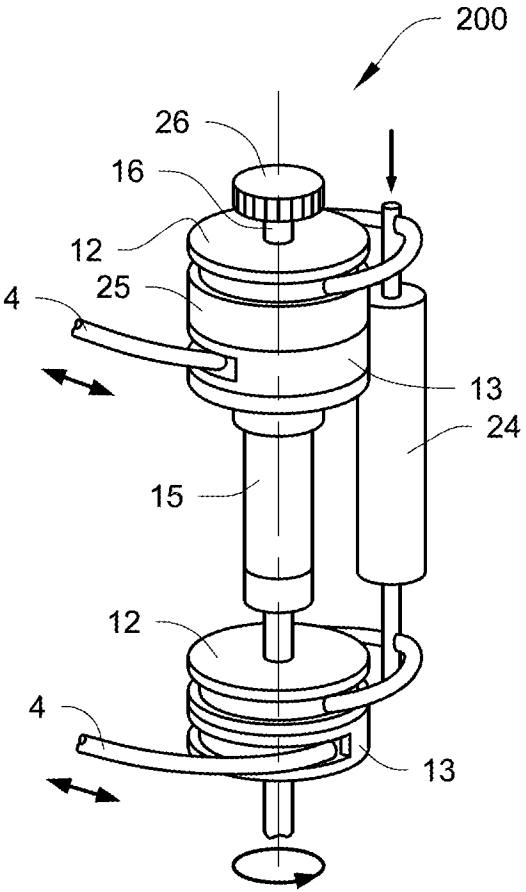

As detailed in FIG. 8B, this connection or disconnection is performed as follows: by actuating the auxiliary mechanism (24) the two sliding discs (12) are simultaneously separated from their respective driving discs (13) (those receiving the reciprocating movements of the connecting rods (4)), wherewith the male-female inserts (23) cease to be assembled (in this preferred embodiment this type of male-female mechanical connection has been used for creating the connection of the two discs (12, 13) of each clutch, but it could be any other equivalent connection, for example, electromagnetic clutches). This releases the two concentric shafts (15, 16) so that they can be integrally rotated about their common geometric axis, in order to seek further directions for the swing frames (17, 17') and thus for the propulsion force.

But these rotations should be in a sync manner in order to avoid angle lags between the two shafts. This is performed by the synchronization device (25) that is automatically actuated. When moving the upper sliding disc (12), it connects the synchronization device (25), thus establishing the temporary connection of the two shafts (15, 16), which allows rotating thereof in unison (synchronized).

These rotations are performed by actuating the rotation mechanism (26) which will rotate the synchronized shafts (15, 16) to the new working position chosen for the blades (21).

Once the shafts (15, 16) have been rotated to the desired position (FIG. 8A), the actuation direction of the auxiliary mechanism (24) is reversed, wherewith the rotation (26) and synchronization (25) mechanisms between the shafts (15, 16) are automatically disconnected, while the male-female inserts (23) are connected again. This allows rotating again the drive shaft (1) so that the blades (21) generate propulsion in this new direction.

The invention claimed is:

1. A multidirectional propulsion apparatus for a ship in water, the water having a surface, comprising:

a motor and a drive shaft driven by the motor;

a drive system including a hypocycloid transformer, the hypocycloid transformer including a pair of directrix crown wheels, a pair of satellite gears which are integral with respective bolt discs, and a pair of elastic connecting rods, each bolt disc having a bolt fixed thereon such that the bolts are located at 180 degrees from each other, each bolt describing a reciprocating path in a straight line of constant length and equal to a pitch diameter of the respective directrix crown wheel, wherein the drive shaft drives the drive system by transmitting rotation to the satellite gears which roll inside the respective directrix crown wheel;

a fish-tail propulsion system for submersion beneath the water surface, the fish-tail propulsion system having concentric shafts, swing frames each formed by a body and arms that have attached blades for rotating about respective axes, and stops, the swing frames being connected to the respective shafts through an elastic connection, wherein the concentric shafts move the swing frames in oscillation between the stops and provide thrust force for the ship; and a multidirectional connection system having clutches, the multidirectional connection system connecting the drive system to the fish-tail propulsion system through the clutches, the clutches each having a driving disc and a sliding disc;

wherein the bolts of the hypocycloid transformer are connected to the elastic connecting rods of the drive system which are connected to the driving discs of the multidirectional connection system so as to transmit reciprocating movements to the driving discs, the driving discs moving the respective concentric shafts of the fish-tail propulsion system via the sliding discs with both of the concentric shafts performing synchronized rotating-oscillating movements and in opposite directions and never completing complete revolutions, and wherein orientation of propulsion force of the blades of the fish-tail propulsion system can be changed to any horizontal direction and course between 0 and 360 degrees by using the clutches on the concentric shafts thereby changing the direction and course of the propulsion force applied to the ship.

2. The multidirectional propulsion apparatus of claim 1 wherein the drive system can be integrally rotated about its own geometric axis, gradually varying range of sweep angle of the swing frames whether the propulsion system is running or stopped.

3. The multidirectional propulsion apparatus of claim 1 wherein the multidirectional connection system includes:

a connecting mechanism between each pair of one of the driving discs and one of the sliding discs of one of the clutches which is capable of transmitting, when the pair is clutched together, the reciprocating movements of the connecting rods of the drive system to the corresponding concentric shafts of the fish-tail propulsion system thereby making them roto-oscillate;

an auxiliary mechanism which allows for the concentric shafts of the fish-tail propulsion system to be disconnected from each other;

a synchronization mechanism which allows for the concentric shafts of the fish-tail propulsion system, once disconnected from each other by action of the auxiliary mechanism, to be connected to one another; and a rotation mechanism which allows the concentric shafts to integrally rotate about a common geometric axis when synchronized by the synchronization mechanism.

4. The multidirectional propulsion apparatus of claim 3 wherein the multidirectional connection system includes bearings and each of the sliding discs of the clutches has a body with annular slots to house the bearings and wherein the auxiliary mechanism includes a pair of rods which are parallel and diametrically opposed to one another relative to the sliding discs and which can be simultaneously raised or lowered to move the sliding discs.

5. The multidirectional propulsion apparatus of claim 4 wherein the synchronization mechanism includes a synchronizer disc that can slide, but not rotate, on an upper end of the outer concentric shaft and which is housed in the body of the sliding disc, the synchronization mechanism also including a support disc fixed on the inner concentric shaft.

6. The multidirectional propulsion apparatus of claim 3 wherein the rotation mechanism includes a central shaft with a flywheel attached to an upper end and a groove at a lower end, the rotation mechanism further including a spline ring attached to the sliding disc of the clutch so that when the sliding disc is raised and the spline ring engages the groove, a temporary connection is formed between the central shaft with the flywheel and the concentric shafts of the fish-tail propulsion system which allows transmitting the rotation of the flywheel to the concentric shafts when synchronized.

* * * * *